United States Patent [19]

Razus

[11] 4,292,743

[45] Oct. 6, 1981

[54] CEREAL DRYER

[76] Inventor: Virgiliu T. Razus, 12, Avenue Gaspard-Valette, 1206 Geneva, Switzerland

[21] Appl. No.: 98,334

[22] Filed: Nov. 27, 1979

[51] Int. Cl.[3] ..... F26B 17/16

[52] U.S. Cl. ..... 34/65; 34/168; 34/177

[58] Field of Search ..... 34/168, 177, 65; 432/222

[56] References Cited

U.S. PATENT DOCUMENTS

| | | | |
|---|---|---|---|
| 1,606,390 | 11/1926 | Schmuck | 432/222 |
| 2,480,146 | 8/1949 | Lee | 34/169 |
| 2,552,254 | 5/1951 | Brunschwyler | 34/177 |
| 3,913,239 | 10/1975 | Burgin | 34/177 |

*Primary Examiner*—Larry I. Schwartz

*Attorney, Agent, or Firm*—Robert E. Burns; Emmanuel J. Lobato; Bruce L. Adams

[57] ABSTRACT

Cereal grain dryer comprising an elongated vertical casing defining an open ended enclosure. A combustion chamber provides hot combustion gases divided into two streams: one flowing into a coil lining an upper section of the casing and the other flowing through a radiator which heats up air before the latter moves horizontally across the enclosure by passing through two orifices of the casing. The casing is likewise horizontally traversed by a cold air stream passing through two further casing orifices, below the hot air stream. The cereal grains fall vertically through the enclosure and are moved by gravity. They are dried with a good thermal efficiency without coming in contact with the combustion gases.

4 Claims, 1 Drawing Figure

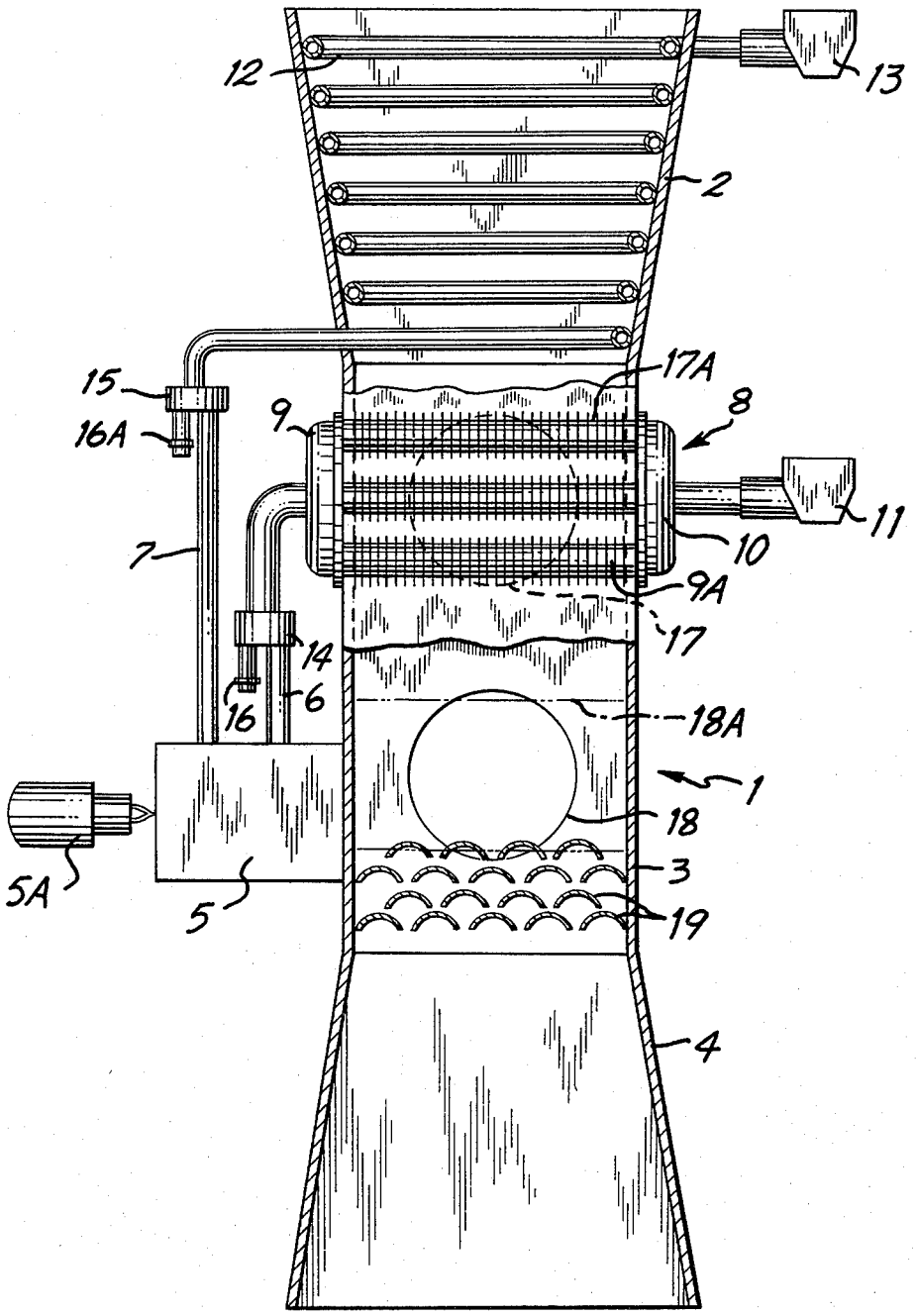
12
13
2
15
16A
9
17A
8
11
10
7
9A
17
14
6
16
18A
1
18
5A
5
3
19
4

CEREAL DRYER

The present invention relates to a cereal grain dryer.

Cereal dryers are known wherein the cereal grains come in contact directly with hot combustion gases resulting from the combustion of a liquid or a solid fuel. These dryers give a good efficiency but the condensable products contained in the combustion gases partially settle on the goods and alter their quality.

Cereal dryers are also known wherein the cereal grains are dried by hot air produced by radiators having tubes through which steam flows. The cereals thus dried are of a good quality but the indirect drying by steam gives a poor thermal efficiency and, consequently, requires a lot of fuel.

It is an object of the present invention to associate the advantages of the aforesaid known systems by drying cereals by means of hot air produced by a heat exchanger wherein the heating medium are combustion gases.

Accordingly, the invention claimed herein is a cereal grain dryer which comprises a casing defining an enclosure having an inlet and an outlet opening for the movement of cereal grains through the casing and an admission and a discharge orifice for the flow of hot air in the casing, means being provided for moving the hot air flow from the admission orifice to the discharge orifice. A heat exchanger is mounted to span the admission orifice and means are provided for producing a flow of hot combustion gases and feeding them to the heat exchanger. The latter has exchange wall means exposed on the outer face to air to produce the hot air flow and, on the inner face, to the flow of hot combustion gases.

According to a preferred embodiment, the casing stands upright with the inlet opening being provided at the top and the outlet opening being provided at the bottom whereby the cereal grains circulate through the casing by gravity, the latter having an upper section and a middle section below the upper section. In this embodiment, a heating coil may line the inner face of the upper section with means connecting this coil to the means producing a flow of hot combustion gases to provide the hot combustion gases required for the heating coil. Also, the admission and discharge orifices for the hot air flow may be provided in facing walls of the middle section whereby the hot air flow circulates horizontally across the middle section of the casing.

Other objects and further advantages of the invention will be gathered from the following description of a preferred embodiment thereof, the description referring to the single enclosed FIGURE of drawing of an elevation view partially broken away to illustrate, in cross-section, certain inner features of the dryer.

The illustrated cereal dryer comprises a vertical metal casing 1 defining an inner enclosure having end openings, the casing being rectangular in horizontal cross-section. This casing is divided, from top to bottom, into a converging transpiration section 2, a middle section 3 and a diverging cooling section 4. On one sidewall of the middle section is secured a combustion chamber 5 in which the flame of an oil burner 5A burns. The combustion gases come out of the chamber 5 through two pipes 6 and 7. The gases coming out of pipe 6 are received in a heat exchanger 8 disposed laterally of and on the outside of the casing 1, along the upper half of the middle portion. This heat exchanger appears in the form of a radiator comprising a distributing conduit 9, a vertical row of horizontal finned tubes 9A and a collecting conduit 10. The combustion gases are finally discharged through a suction blower 11 into a flue, not shown. The combustion gases coming out of the combustion chamber 5 through the conduit 7 flow across a coil 12 which lines the inner face of the transpiration section 2 and are discharged through a suction blower 13 likewise into a flue, not shown. On each of the pipes 6 and 7, there is provided a chamber, respectively 14 and 15, for controlling the temperature of the gases. The chambers are each provided with a dilution air inlet opening controlled by a damper, respectively 16 and 16A.

The back wall of the rectangular middle section 3 has two circular discharge orifices 17 and 18 in which two suction blowers (not shown) are mounted. The orifice 17 stands at the level of the radiator 8. The front wall of the middle section has two rectangular openings 17A and 18A, one at the level of the radiator and of the same size as the radiator, the other at the level of the discharge opening 18.

The lower end of the middle section 3 is provided with upwardly convex cylindrical baffles 19 extending between the back and front walls of the casing. These baffles are arranged in staggered relationship along a plurality of horizontal rows, spacing being provided between rows and between baffles of the same rows.

In operation, the cereal grains are fed from above the upper opening of the casing 1 by any known means, such as a belt conveyor, fall into the upper transpiration section 2 and move through it. In this section, the cereal grains are heated by radiation by the coil 12 and lose their surface moisture. The grains thereafter fall into the middle section 3 of the casing where they meet a horizontal hot air flow produced by the radiator 8, which hot air flow penetrates the casing through the admission orifice 17A located forwardly of the radiator in the front wall of the casing and exits through the suction blower mounted in the discharge orifice 17. The dried grains keep on falling in the middle section 3 and come across a horizontal cold air flow which enters into the casing through the admission orifice 18A of the front wall, located at the level of the discharge orifice 18. The cold air flow is discharged out of the casing through a suction blower mounted in the discharge orifice 18. The grains are thereafter temporarily retained by the baffles 19 for partial cooling, final cooling being provided in the cooling section 4 where the grains move counterflow in a rising flow of cold air drawn by the blower mounted in the discharge orifice 18. The grains that come out of the outlet opening of the casing 1 are collected and moved to a packaging site by any appropriate means such as a belt conveyor, not shown.

I claim:

1. Cereal grain dryer, comprising: a casing defining an enclosure having an inlet and an outlet opening for movement of cereal grains through said casing and an admission and a discharge orifice for the flow of hot air in said casing; means for moving said hot air flow from said admission to said discharge orifices; a heat exchanger mounted to span said admission orifice and means producing a flow of hot combustion gases and feeding them to said heat exchanger, said heat exchanger having exchange wall means exposed on the outer face thereof to said air to produce said hot air flow and, on the inner face, to said flow of hot combustion gases, wherein said casing stands upright with said inlet opening being provided at the top and said outlet opening being provided at the bottom whereby said cereal grains circulate through said casing by gravity; wherein said casing has an upper section and a middle section below said upper section; wherein a heating coil lines the inner face of said upper section and means connect said coil to said means producing a flow of hot combustion gases to provide hot combustion gases to said heating coil, and wherein said admission and discharge orifices for said hot air flow are provided in facing walls of said middle section whereby said hot air flow circulates horizontally across said middle section of said casing.

2. Cereal grain dryer as claimed in claim 1, including additional admission and discharge orifices in opposite walls of said middle section for the circulation of unheated air horizontally across said middle section below the hot air flow.

3. Cereal grain dryer as claimed in claim 2, including baffle means below said unheated air flow for temporarily retaining cereal grains in said casing before falling out through said outlet opening.

4. A cereal grain dryer as claimed in claims 1, 2 or 3, wherein said means for producing a flow of hot conductor gases comprise a conduit connected to said heat exchanger, said conduit having a damper-controlled air inlet.

* * * * *